US005941744A

United States Patent [19]

Levedahl

[11] Patent Number: 5,941,744

[45] Date of Patent: Aug. 24, 1999

[54] VECTORED PROPULSION SYSTEM FOR SEA-GOING VESSELS

[75] Inventor: William J. Levedahl, Annapolis, Md.

[73] Assignee: The United States of America as represented by the Secretary of the Navy, Washington, D.C.

[21] Appl. No.: 08/925,647

[22] Filed: Sep. 9, 1997

Related U.S. Application Data

[63] Continuation-in-part of application No. 08/700,750, Aug. 16, 1996, Pat. No. 5,684,690.

[51] Int. Cl.[6] ..... B60L 11/02

[52] U.S. Cl. ..... 440/6; 440/53; 440/67

[58] Field of Search ..... 440/49, 53, 57, 440/6, 67; 310/87, 114, 162

[56] References Cited

U.S. PATENT DOCUMENTS 4,831,297 5/1989 Taylor et al. ..... 440/6
5,078,628 1/1992 Garis, Jr. .
5,289,068 2/1994 Veronesi et al. ..... 310/114
5,684,690 11/1997 Levedahl .

*Primary Examiner*—Ed Swinehart
*Attorney, Agent, or Firm*—John Forrest; Jacob Shuster

[57] ABSTRACT

A thrust block is positioned by a steerable support in spaced relation to the hull of a seagoing vessel for angular displacement about a propeller axis and the axis of said hull intersecting the propeller axis. Forward and aft sets of propellers are rotatably mounted by hubs in the thrust block for contrarotation by propulsion motors having rotors respectively fixed to the radially outer tips of forward and aft propeller blades and electrically energized by current conducted thereto through stator and rotor windings of transformers respectively mounted in the thrust block and the propeller hubs to avoid propulsive torque transmission by the thrust block. The rotors of the propulsion motors are protectively enclosed by a radially outer shroud assembly which accommodates hydrodynamic cooling during motor operation.

14 Claims, 2 Drawing Sheets

FIG. 3
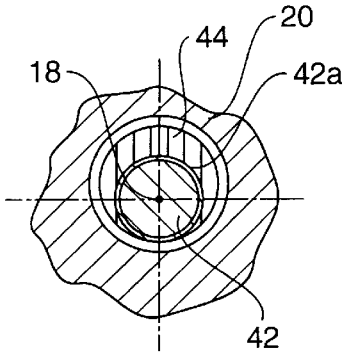
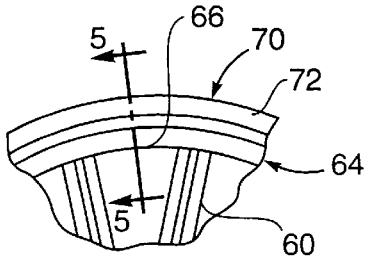
FIG. 4
FIG. 5
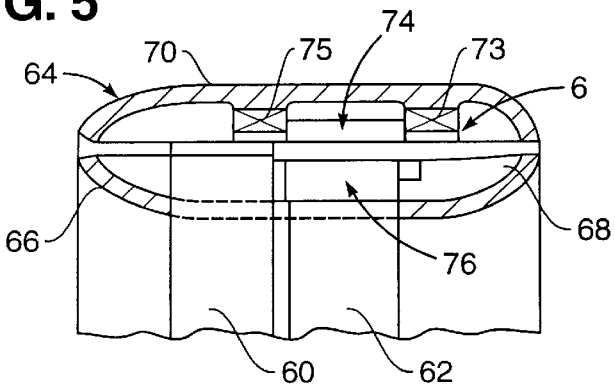
FIG. 6
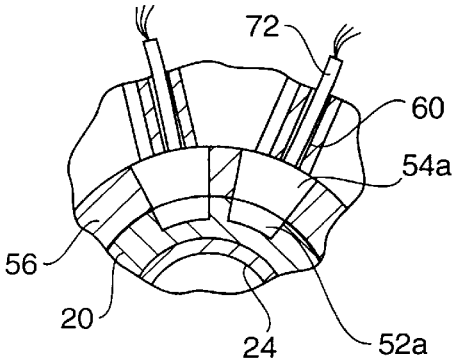
FIG. 7
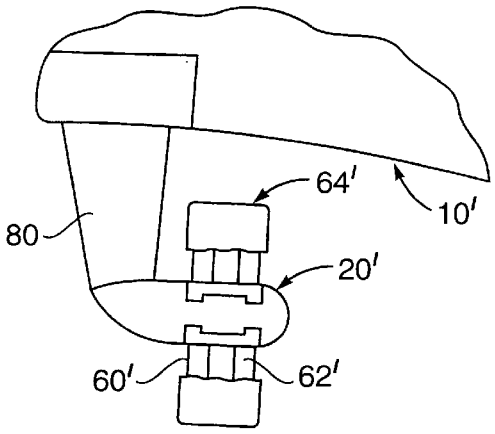

VECTORED PROPULSION SYSTEM FOR SEA-GOING VESSELS

This application is a continuation in part of application Ser. No. 08/700,750, now U.S. Pat. No. 5,684,690, filed Aug. 16, 1996.

BACKGROUND OF THE INVENTION

The present invention relates generally to integrated propulsion and steerage of seagoing vessels or the like.

Currently, seagoing vessels having watertight hulls are propelled by gear driven propellers. Maneuvering of such vessels involves use of separate steering facilities such as rudders externally of the hull and reversible pitch propellers on surface ships or separate reverse turbines in submarines. The latter referred to facilities associated with propulsion and steerage operations for marine vessels not only involve expensive equipment subject to costly dry-dock repair and/or maintenance, but are responsible for high fuel consumption, difficulties in maneuvering and create noise and vibration problems.

In an attempt to solve some of the problems associated with the foregoing facilities, such as fuel consumption and those problems associated with use of reversible pitch propellers, integrated electrical drive systems have been proposed as disclosed for example in a related prior copending application Ser. No. 08/700,750 filed Aug. 16, 1996, now U.S. Pat. No. 5,684,690, with respect to which the present application is a continuation-in-part. However, little improvement in maneuverability or noise generation is thereby achieved.

It is therefore an important object of the present invention to provide an arrangement of integrated propulsion and steerage for marine vessels so as to improve maneuverability while avoiding the problems heretofore experienced such as high fuel consumption, costly repair and noise generation.

SUMMARY OF THE INVENTION

In accordance with the present invention, vectored propulsion for a marine vessel is provided by contrarotating propellers rotatably mounted by forward and aft hubs on a thrust block carried on a steerable support externally of the vessel hull through which electrical power is supplied to propulsion motors. The thrust block in addition to journaling of the propeller hubs without torque transmission, mounts transformers having stator and rotor windings through which the electrical power is transmitted to the windings of torque producing rotors of the propulsion motors mounted on the radially outer tips of the aft and forward propellers for contrarotation thereof. Such outer tips of the propeller blades and the propulsion motors associated therewith are protectively enclosed within shrouds through which hydrodynamic cooling of the propulsion motors is effected.

In the case of a submarine installation, the steerable support for the thrust block is a spherical ball positioned in spaced relation to the hull by a tubular spindle through which a power cable extends for supply of the electrical power through electrical conductors within the aft propeller blades, to the propulsion motors. The thrust block is connected to and rotatable with a tail cone within which a geared steering motor is mounted for rotation of a steering rod which extends therefrom through a hole within the thrust block for limiting its angular displacement of a propeller axis by another geared steering motor positioned within the ball. Electrical power for operation of such steering motors is also supplied through the aforementioned power cable in the ball positioning spindle. Steering operation is thereby effected by angular displacement of the propeller carrying thrust block about the propeller axis and displacement of such axis relative to the longitudinal axis of the hull at its intersection with the hull axis at the center of the ball and the thrust block rotatable thereon.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein:

FIG. 3 is a partial section view taken substantially through a plane indicated by section line 3—3 in FIG. 2;

FIG. 4 is a partial section view taken substantially through a plane indicated by section line 4—4 in FIG. 1;

FIG. 5 is a section view taken substantially through a plane indicated by section line 5—5 in FIG. 4;

FIG. 6 is a section view taken substantially through a plane indicated by section line 6—6 in FIG. 2; and FIG. 7 is a partial side elevation view of another installational arrangement for a vectored propulsion unit in accordance with another embodiment of the invention.

DETAILED DESCRIPTION OF PREFERRED EMBODIMENTS

Figure 1:
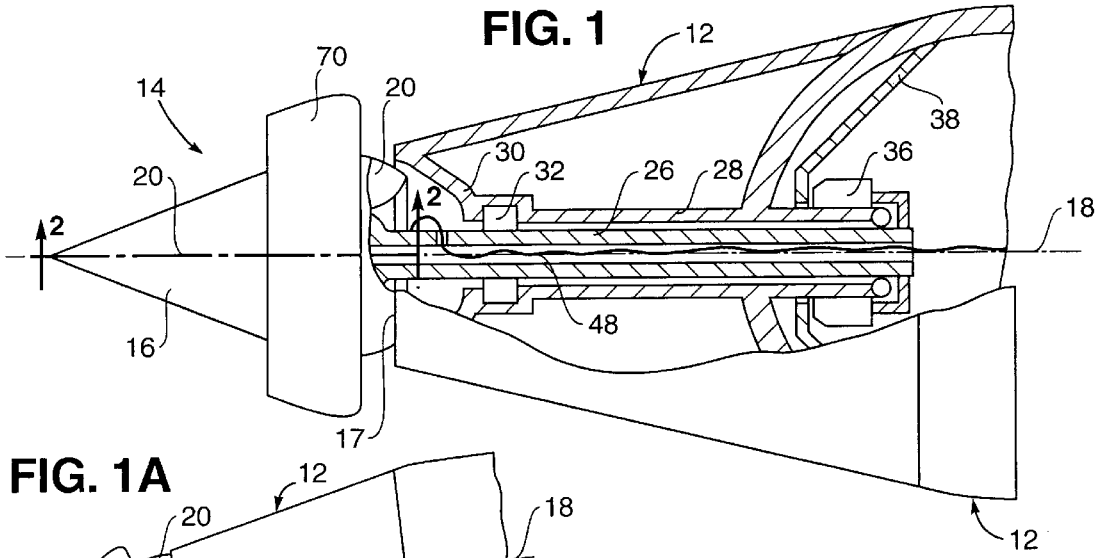
FIG. 1 is a side elevation view with a portion shown in section of the aft end portion of a submarine at which a vectored propulsion unit is mounted in accordance with one embodiment of the invention.
Figure 1A:
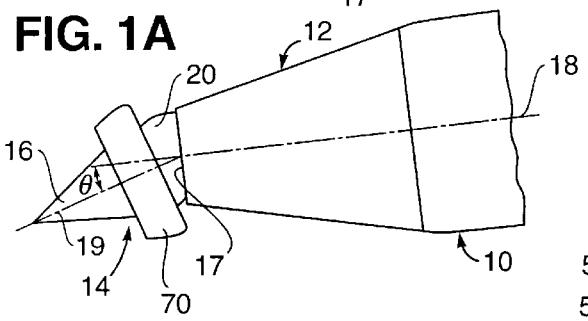
FIG. 1A is a partial side elevation view similar to that of FIG. 1 showing angular displacement of the vectored propulsion unit from the hull aligned position shown in FIG. 1.

Referring to the drawing in detail, FIG. 1 illustrates the rear or aft end portion of a sea-going vessel such as an underwater submarine having a pressure hull 10 to which a rearwardly convergent, non-pressure hull section 12 is attached. A vectored propulsion unit generally referred to by reference numeral 14 projects rearwardly from the rear end 17 of the non-pressure hull section 12, terminating in a tail cone 16. In such installational embodiment, the vectored propulsion unit 14 undergoes selective angular displacement in all directions relative to a longitudinal axis 18 of the hull 10 within a limited angular range (θ), such as 15°, between a propeller axis 19 through the tail cone 16 and the axis 18 of hull 10 as shown in FIG. 1A.

Figure 2:
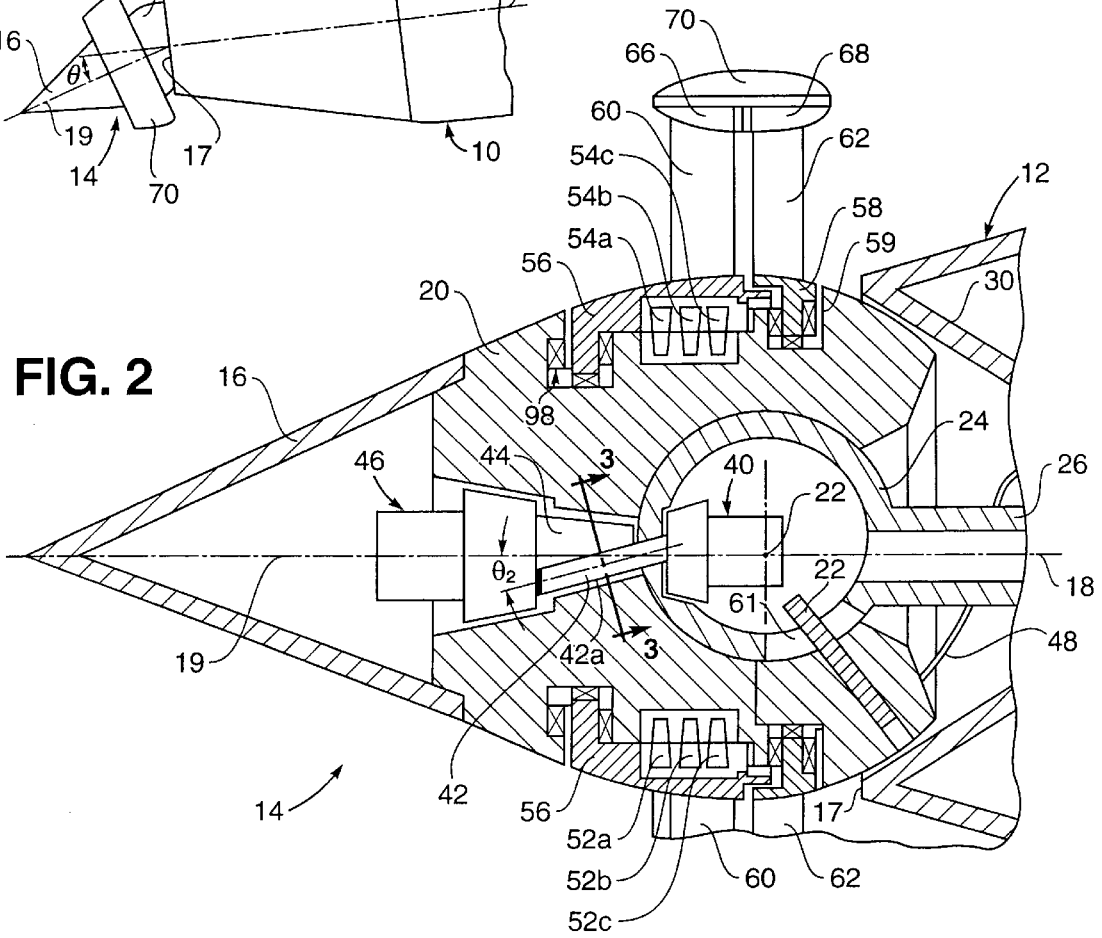
FIG. 2 is an enlarged partial section view taken substantially through a plane indicated by section line 2—2 in FIG. 1.

Referring now to FIG. 2 in particular, the vectored propulsion unit 14 includes a thrust block 20 to which the tail cone 16 is fixed. The thrust block 20 internally encloses a spherical bearing socket having a center 22 at the intersection of the hull axis 18 and the propeller axis 19. Such socket forms a lubricated bearing surface rotationally supporting the thrust block 20 on a rotationally fixed spherical ball 24 from which a tubular spindle 26 extends longitudinally along the hull axis 18 into the hull 10 as shown in FIG. 1. The tubular spindle 26 is so coaxially positioned within a tubular support 28 fixed to the hull 10 and to the non-pressure hull section 12 at its aft end 17 through a conical support element 30 into which the thrust block 20 projects in close spaced relation thereto. A radial vibration reducer 32 is positioned between the element 30 and the spindle 26 in order to minimize transmission of vibrations to the hull 10. A thrust vibration reducer 36 positioned on the tubular support 28 within the hull 10 is connected to the forward end of spindle 26 while in abutment with a thrust member 38 fixed to the hull 10 so as to attenuate thrust pulsation applied thereto by the unit 14 during operation.

With continued reference to FIG. 2, a geared electric motor assembly 40 is disposed within the hollow ball 24, and has a steering rod 42 extending therefrom at an angle $\theta_2$ to the hull axis 18 through an aft opening in the ball 24, to form part of a steering mechanism. A second geared electric motor 46 is disposed in the thrust block 20, and has a steering cone 44 extending therefrom into a conical hole in the thrust block 20 which is aligned with the propeller axis 19. The steering cone 44 has a cylindrical hole 42*a* formed therein at said angle ($\theta_2$) to the steering cone axis 19 so as to mate with steering rod 42 extending through such hole 42*a* as shown in FIG. 3. By rotating steering rod 42 and steering cone 44 independently, the propeller axis 19 can be oriented at any angle up to ($\theta$) from the hull axis 18, and at any azimuthal angle. The thrust block 20 itself is prevented from rotation about the hull axis 18 while being rotated in planes containing the axis 18 by means of a pin 50 inserted into the thrust block 20 and extending through slot 51 in the ball 24.

Electric power for steering operation of the geared motor assemblies 40 and 46 of the steering mechanism is supplied thereto by a flexible power cable 48 extending from the hull 10 into the spindle 26 as shown in FIGS. 1 and 2. The thrust block 20 which is angularly displaceable on the ball 24 as hereinbefore described, carries propulsion means of the propeller type that is also powered by the electrical energy supplied through the power cable 48 within spindle 26. Such power cable 48 is electrically connected to three ring winding transformers respectively having circumferentially inner primary windings 52*a*, 52*b* and 52*c* fixedly mounted in close axially spaced relation to each other within the thrust block 20 as shown in FIG. 2. Each primary winding 52 is associated with a radially outer secondary winding 54*a*, 54*b* and 54*c* that is rotatable about the propeller axis 19. Toward that end, the secondary windings 54*a*, 54*b* and 54*c* are carried by an annular aft hub 56 mounted for rotation in the thrust block 20 by thrust and journal bearings 98. The transformer output from the windings 54 is carried by wiring 72 as shown in FIG. 6 through a plurality of circumferentially spaced hollow aft propeller blades 60 outward to an outer shroud assembly 64 within which an induction type of propulsion motor assembly 69 is mounted as shown in FIG. 5. An annular forward hub 58 is carried by thrust and journal bearing 97 within a recess 59 in the thrust block 20 as shown in FIG. 2. Such hub 58 carries a plurality of circumferentially-spaced propeller blades 62 of pitch opposite to that of the aft propeller blades 62 as shown in FIG. 4. An induction rotor 76 supported by the ends of blades 60 forms the contrarotating member of the motor assembly 69. Annular shroud sections 66 and 68 are respectively fixed to the sets of aft and forward propeller blades 60 and 62 while hydrodynamically shrouding their propellers as shown in FIG. 5. A radially outer shroud 70 is mounted in floating relation to a radially outer rotor 74 of the induction propulsion motor assembly 69. Axial bearings 73 and 75 provide the floatational mounting support for the shroud section 70 on the rotor 74 so that its rotational speed may be hydrodynamically reduced from that of the rotor 76 fixed to the blades 62.

The rotors 74 and 76 of the propulsion motor 69 are powered through the three torqueless transformers formed by the primary stator and secondary rotor windings 52 and 54 carried on the aft propeller hub 56. The transformer secondary rotor windings 54 are electrically connected to the electrical wiring 72 extending through the aft propeller blades 60 as shown in FIG. 6 so as to transmit electrical energy to the propulsion motors of assembly 69 without cutting transformer flux lines and accommodate three phase motor operation to drive the sets of aft and forward propeller blades 60 and 62 which are made of metal or a composite. The difference in numbers of propeller blades 60 and 62 for each aft and forward set is at least two, in order to minimize generation of acoustic signals. A selection of nine aft blades 60 was found to be judicious for three phase motor operation.

Based on the foregoing description of the constructional arrangement associated with the vectored propulsion unit 14, heat generated by electrical resistance and eddy currents during motor operation is removed to a substantial extent by seawater convection cooling of the rotors 74 and 76 within shroud sections 66, 68 and 70. Also separation of the primary and secondary transformer windings 52 and 54 forms a small water gap through which direct transformer cooling occurs.

The arrangement associated with the propulsion portion of the unit 14 hereinbefore described, including the ring transformers formed by the windings 54 and 56, the thrust block 20, the aft and forward sets of propeller blades 60 and 62 and the radially outer shroud assembly 64 with the rotors 74 and 76 of the propulsion motor 69 enclosed therein and respectively connected to the tips of the propeller blades, may be adapted for mounting separately from the steering mechanism in other installations such as surface ships and hydrofoils. In connection with a surface vessel 10' for example, as shown in FIG. 7, a thrust block type support 20' is connected to the vessel 10' through a steerable strut 80. The thrust block 20', like the thrust block 20 hereinbefore described, mounts aft and forward sets of contrarotating propellers 60' and 62' with the induction and synchronous propulsion rotors associated therewith within a radially outer shroud assembly 64'.

The supply of power for propulsion purposes through cable 48 to the vectored propulsion unit 14 as hereinbefore described with respect to FIG. 1 may be controlled in accordance with the disclosure in the aforementioned prior copending parent application, now U.S. Pat. No. 5,684,690. Electrical power for steering purposes under suitable controls is also supplied through the cable 48 to the steering motor assemblies 40 and 46, in the case of the embodiment shown in FIG. 2.

The induction rotors 74 and 76 as hereinbefore described may be replaced by a multipole permanent-magnet rotor. The forward and aft rotors could be interchanged. Many bearing systems and ducting configurations are possible. Thus, other modifications and variations of the present invention may be possible in light of the foregoing teachings. It is therefore to be understood that within the scope of the appended claims the invention may be practiced otherwise than as specifically described.

What is claimed is:

1. In combination with a sea-going vessel having a longitudinal axis and a source of electrical energy, a vectored propulsion system for propelling the vessel comprising: a thrust block having a propeller axis; contrarotating propellers mounted for rotation by said thrust block about said propeller axis, said contrarotating propellers having a forward hub with a plurality of forward blades projecting radially therefrom and an aft hub with a plurality of aft blades projecting radially therefrom, said forward and aft blades having radially outer tips; motor means operatively mounted on said propellers and including: contrarotating rotors respectively connected to the forward and aft blades; rotating field transformer means for transmitting the electrical energy and means for electrically connecting said transformer means to the contrarotating rotors for imparting contrarotation thereto when the electrical energy received is transmitted by the transformer means; and steering means operatively connected to said thrust block for angular displacement of the propeller axis relative to said longitudinal axis of the vessel during said vectored propulsion thereof.

2. In combination with a sea-going vessel having a longitudinal axis and a source of electrical energy, a vectored propulsion system for propelling the vessel comprising:

a thrust block connected to the vessel;

contrarotating propellers mounted for rotation by said thrust block, said contrarotating propellers having a forward hub with a plurality of forward blades projecting radially therefrom and an aft hub with a plurality of aft blades projecting radially therefrom, said forward and aft blades having radially outer tips;

motor means operatively mounted on said propellers and receiving said electric energy imparting contrarotation to said propellers; and steering means for angularly displacing said thrust block relative to said longitudinal axis of the vessel during said vectored propulsion thereof, said motor means comprising: an induction rotor connected to said outer tips of the forward blades and a synchronous rotor affixed to said outer tips of the aft blades.

3. A system as in claim 2 further including;

shroud means surrounding said contrarotating propellers, having an inner forward section connected to and rotating with the forward blades of said propellers, an inner aft section connected to and rotating with the aft blades of said aft propellers, and an outer section enclosing said motor means.

4. A system as in claim 3 wherein said outer section is mounted on said synchronous rotor through a floating support for rotation at a speed less than that of said synchronous rotor.

5. A system as defined in claim 2 wherein said vessel is a submarine, said system further including:

a spindle affixed to an aft end of the vessel; and a non-rotating ball attached to said spindle on which said thrust block is rotationally mounted.

6. A system as defined in claim 5 further including powered steering means extending into the ball through the thrust block for rotation thereof about both the longitudinal axis of the vessel and a propeller axis intersecting the longitudinal axis within the ball.

7. A vectored propulsion system for providing propulsive and maneuvering thrust to a vessel having a longitudinal axis and a source of electrical energy, comprising:

a spindle affixed to an aft end of the vessel;

a non-rotating ball attached to said spindle;

a thrust block having a substantially spherical socket receiving said ball;

contrarotating propeller means rotatably mounted by said thrust block, including a forward hub having a plurality of forward blades projecting radially therefrom, an aft hub having a plurality of aft blades projecting radially therefrom, said forward and aft blades having radially outer tips; and three field transformers respectively including: a stator winding mounted in said thrust block radially inwardly of said contrarotating propeller means, a rotor winding mounted in one of said hubs radially outwardly of the stator winding;

propulsion motor means connected to said propeller means at said outer tips of the blades;

means for electrically connecting at least one of the transformers and said motor means; and steering means for rotating said thrust block about an axis of rotation different from said longitudinal axis of the vessel.

8. A system defined in claim 7 wherein:

said thrust block includes bearing surfaces journaling said hubs of the propeller means.

9. A system as defined in claim 8 wherein:

said propulsion motor means comprises: an annular induction rotor connected to and surrounding said outer tips of the forward blades; an annular synchronous rotor surrounding said induction rotor and affixed to said outer tips of the aft blades; and said means for electrically connecting including current conductors extending internally through said aft blades between said rotor winding and the synchronous rotor of the propulsion motor means.

10. A system as defined in claim 9 further comprising:

shroud means surrounding said contrarotating propeller means, including: an inner forward section connected to and rotating with said forward hub of the propeller means, an inner aft section connected to and rotating with said aft hub of the propeller means, and an outer section enclosing said synchronous rotor of the propulsion motor means.

11. A system as in claim 10 wherein said outer section is floatingly supported on the synchronous rotor so as to rotate at a speed less than that of said synchronous rotor.

12. A system as in claim 7 wherein said steering means comprises a rotating mechanical linkage through which rotation is imparted to said thrust block about a propeller axis at an angle to said longitudinal axis of the vessel.

13. In combination with a seagoing vessel having a source of electrical energy within a hull, a system for integrated propulsion and steerage of the vessel, including: a plurality of propellers; a thrust block; a support fixed to and extending externally from said hull on which the thrust block is mounted; propulsion motor means connected to the propellers in radially spaced relation to the thrust block for imparting rotation to the propellers; hub means rotatably supporting the propellers on the thrust block during said rotation by the motor means without applying torque to the thrust block; steering means associated with the support for angular displacement of the thrust block relative to the hull; and means for transmitting power from said source of electrical energy to the motor means through said thrust block during said angular displacement thereof; said support means comprising: an elongated tubular spindle fixed to the hull and a spherical ball fixed to the spindle in spaced relation to the hull, said ball having an external bearing surface on which the thrust block is supported during said angular displacement thereof by the steering means.

14. The combination as defined in claim 13 wherein said means for transmitting power includes: transformer windings respectively mounted by the thrust block and the hub means.

* * * * *